US005584569A

United States Patent [19]

Huang

[11] Patent Number: 5,584,569

[45] Date of Patent: Dec. 17, 1996

[54] SEMICONDUCTOR LASER MODULE

[75] Inventor: Chaochi Huang, Taipei Hsiin, Taiwan

[73] Assignee: Quarton, Inc., Taipei Hsien, Taiwan

[21] Appl. No.: 382,856

[22] Filed: Feb. 3, 1995

[51] Int. Cl.[6] ..... F21V 21/00

[52] U.S. Cl. ..... 362/288; 362/110; 362/259; 362/273; 362/274; 362/289; 362/800

[58] Field of Search ..... 33/241; 42/103; 362/110, 111, 259, 273, 274, 275, 287, 288, 289, 419, 800

[56] References Cited

U.S. PATENT DOCUMENTS

| | | | |
|---|---|---|---|
| 5,033,219 | 7/1991 | Johnson et al. | 362/289 X |
| 5,299,375 | 4/1994 | Thummel et al. | 362/110 X |
| 5,515,636 | 5/1996 | McGarry et al. | 362/110 X |

*Primary Examiner*—Stephen F. Husar

[57] ABSTRACT

A semiconductor laser module including a barrel screwed up with a screw cap and a semiconductor laser beam generating device mounted inside the barrel and triggered to emit a laser beam out of a laser beam firing hole on the screw cap, wherein the semiconductor laser beam generating device has two opposite pairs of planes spaced equiangularly spaced around the periphery and respectively stopped against; the barrel has springs mounted in respective locating holes and respectively stopped against two adjacent planes on the semiconductor laser beam generating device and two adjustment screws mounted in respective screw holes and respectively stopped against the other two adjacent planes of the semiconductor laser beam generating device and turned to align the longitudinal central axis of the position of the semiconductor laser beam generating device with that of the barrel.

1 Claim, 3 Drawing Sheets

SEMICONDUCTOR LASER MODULE

BACKGROUND OF THE INVENTION

The present invention relates to laser modules, and relates more particularly to a simple structure of semiconductor laser module which can be conveniently adjusted to align the laser beam with the center point of the laser beam firing hole.

Various semiconductor laser modules have been developed for use in laser pointers, laser aimers for sports, as well as laser sights for weapons. Exemplars of semiconductor laser modules for use in weapons are known in U.S. Pat. Nos. 3,297,389; 4,859,058; 4,939,863; 5,033,219. However, these semiconductor laser modules are commonly complicated and expensive to manufacture. Furthermore, when a semiconductor laser module is designed for use as a laser sight for a weapon, its precision is critical. However, the precision of a semiconductor laser module is difficult to control because different electronic components have different electric properties. When a semiconductor laser module is assembled, the projecting angle of the laser beam commonly will deviate from the longitudinal central axis of the laser beam firing hole at an angle within ±3°. Therefore, when a semiconductor laser module is installed in a weapon, it must be adjusted to let the laser beam spot be coincided with the sight. In U.S. Pat. Nos. 3,297,389 and 4,939,864, the semiconductor laser beam generating device is made of cylindrical shape and supported on a spring means and two adjustment screws at three bearing points, and the alignment of the semiconductor laser beam generating device is adjusted through the adjustment screws. This laser beam adjustment arrangement has drawbacks. If the cylindrical semiconductor laser beam generating device is not made in perfect roundness, the alignment will be difficult to achieve.

SUMMARY OF THE INVENTION

The present invention provides a semiconductor laser module which can be conveniently and accurately adjusted to align the laser beam with the longitudinal central axis of the semiconductor laser module. This object is achieved by: making four equiangularly spaced planes on the periphery of the semiconductor laser beam generating device of the semiconductor laser module and arranging adjustment screws and springs in respectively holes around the barrel of the semiconductor laser module to stop against the planes of the semiconductor laser beam generating device respectively. When one adjustment screw is turned inwards or outwards, the tension of the corresponding spring is adjusted and, the position of the semiconductor laser beam generating device is relatively adjusted. This arrangement eliminates the problem of considering the roundness of the semiconductor laser beam generating device during its fabrication.

DETAILED DESCRIPTION OF THE PREFERRED EMBODIMENT

Figure 1:
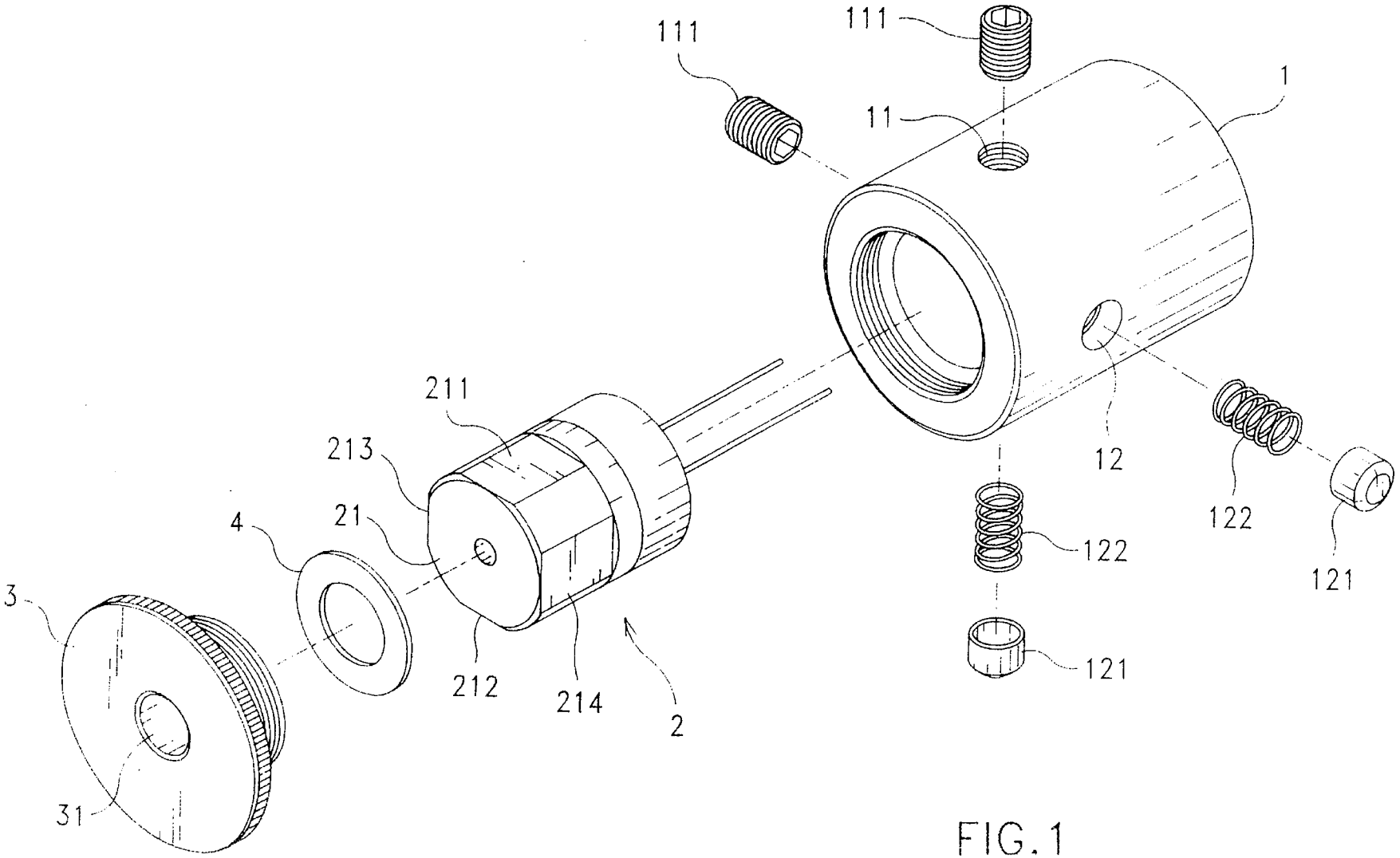
FIG. 1 is an exploded view of a semiconductor laser module according to the present invention.
Figure 2A:
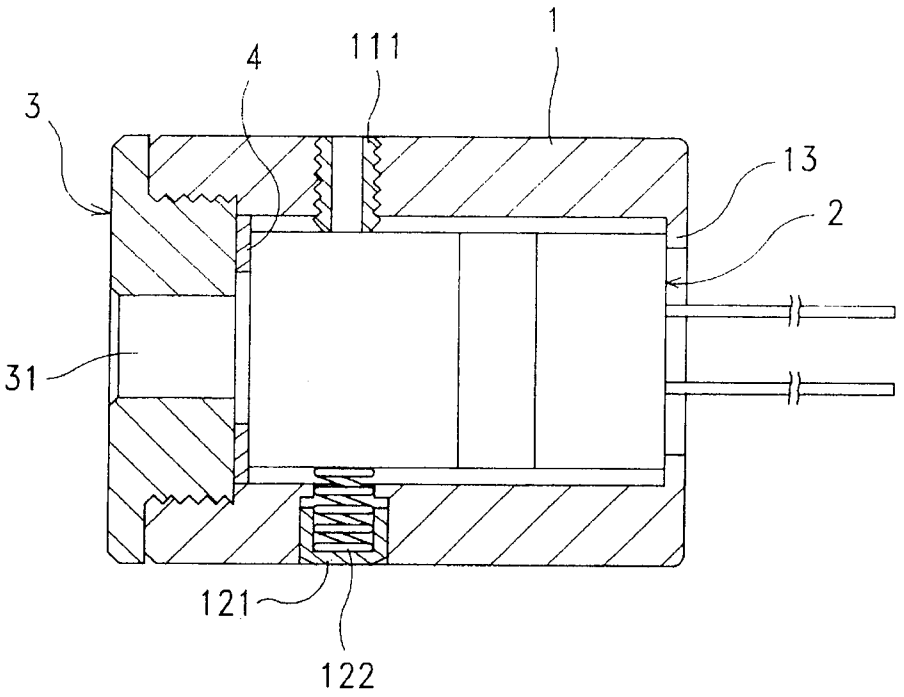
FIG. 2A is a side view in section of the semiconductor laser module shown in FIG. 1.
Figure 2B:
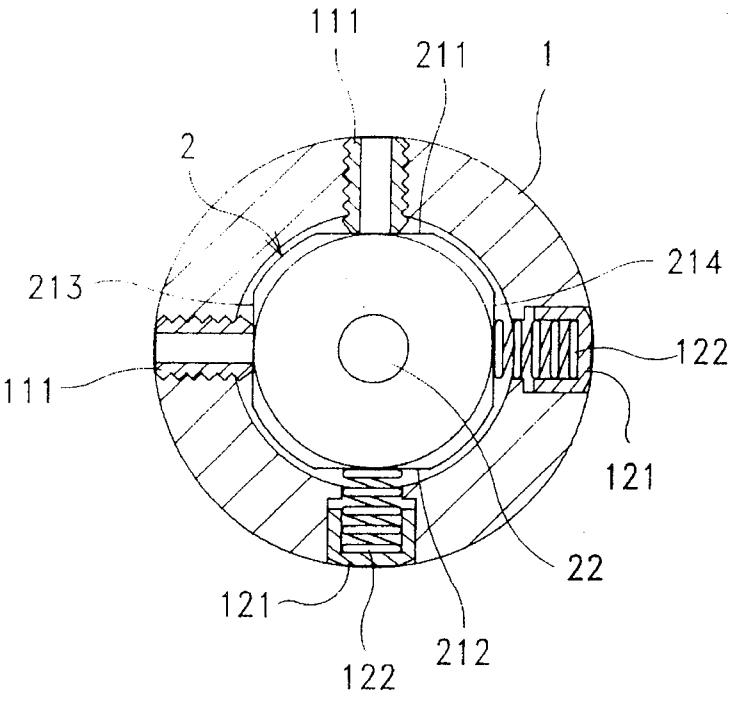
FIG. 2B is a front view in section of the semiconductor laser module shown in FIG. 1.

Referring to FIGS. 1, 2A and 2B, a semiconductor laser module in accordance with the preferred embodiment of the present invention is generally comprised of a barrel 1, a semiconductor laser beam generating device 2, a screw cap 3, and a rubber ring 4. The barrel 1 has an inward annular flange 13 at the rear end. The semiconductor laser beam generating device 2 is inserted into the barrel 1 from the front end and stopped at the inward flange 13, and then the screw cap 3 is fastened to the front end of the barrel 1 through a screw joint. The rubber ring 4 is mounted inside the barrel 1 and stopped between the semiconductor laser beam generating device 2 and the screw cap 3. When the semiconductor laser beam generating device 2 is triggered to produce a laser beam, it is focused by the lens 22 at the front end of the semiconductor laser beam generating device 2 and then sent out of the screw cap 3 through the laser beam firing hole 31 at the center of the screw cap 3. The shell 21 of the semiconductor laser beam generating device 2 has four equal planes, namely the top plane 211, the bottom plane 212, the left plane 213 and right plane 214 equiangularly spaced around the periphery. The outer diameter of the semiconductor laser beam generating device 2 is smaller than the inner diameter of the barrel 1 so that the position of the semiconductor laser beam generating device 2 can be adjusted radially in the barrel 1 (see FIG. 2B). The barrel 1 comprises two screw holes 11 and two locating holes 12 radially disposed around the periphery at locations corresponding to the top and left planes 211 and 213 and the bottom and right planes 212 and 214 respectively. A respective adjustment screw 111 is respectively threaded into each screw hole 11 and stopped against the respective plane 211 or 213 on the semiconductor laser beam generating device 2. A respective plug cap 121 is respectively fastened to each locating hole 12 to hold a respective spring 122 against the respective plane 212 or 214 on the semiconductor laser beam generating device 2.

Figure 3:
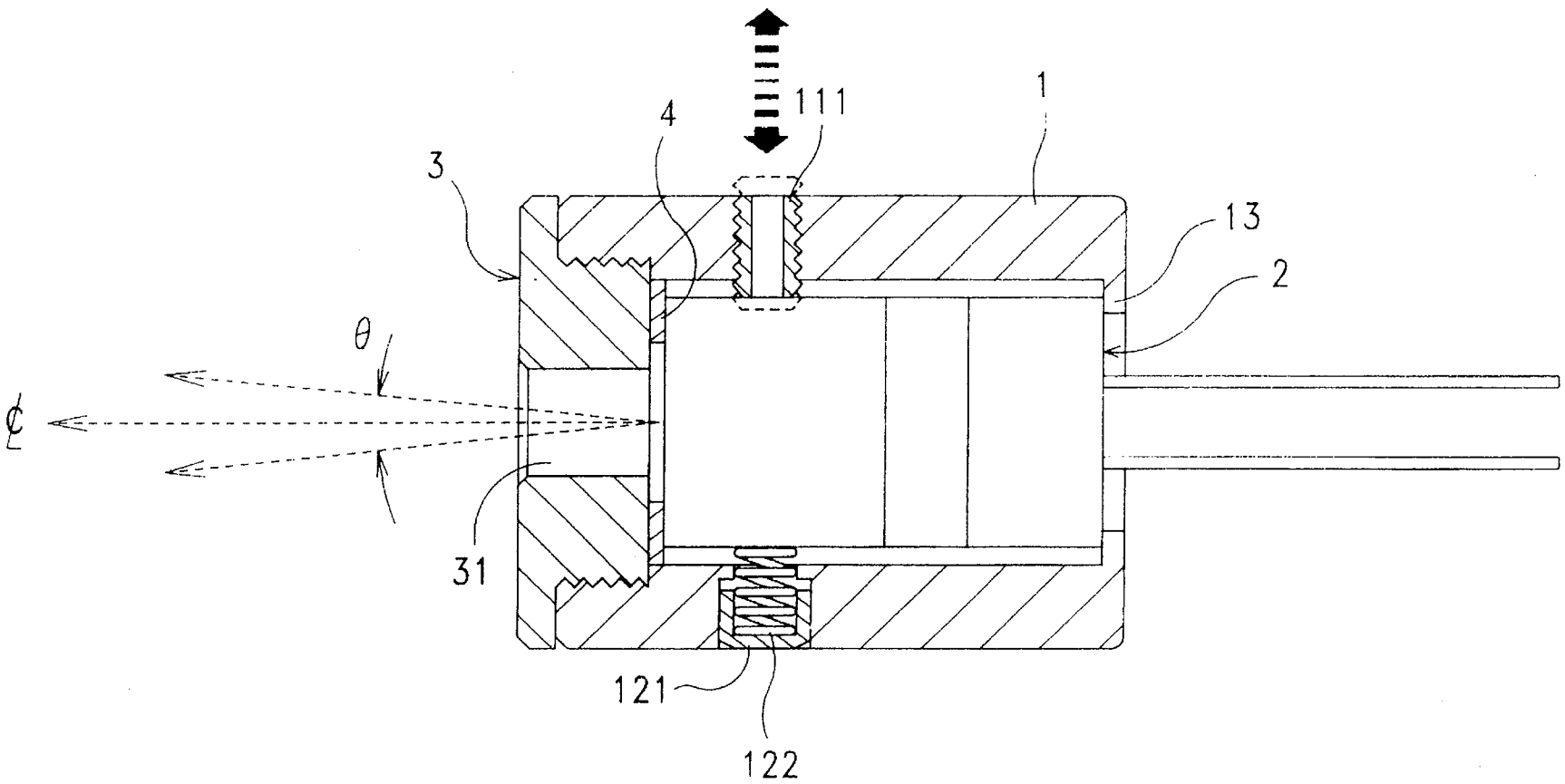
FIG. 3 is similar to FIG. 2A but showing the position of the semiconductor laser beam generating device adjusted.

Referring to FIG. 3, if the laser beam from the semiconductor laser module is deviated from the longitudinal central axis of the semiconductor laser module, it can be conveniently adjusted by turning each adjustment screw 111 inwards or outwards. When one adjustment screw 111 is turned inwards or outwards, the tension of the corresponding spring 112 is relatively changed, and therefore the position of the semiconductor laser beam generating device 2 is adjusted relative to the barrel 1 to align its longitudinal central axis with that of the barrel 1.

While only one embodiment of the present invention has been shown and described, it will be understood that various modifications and changes could be made without departing from the spirit and scope of the invention.

What is claimed is:

1. A semiconductor laser module comprising a barrel having a front open end and a rear end terminating in an inward annular flange, a screw cap fastened to the front open end of said barrel and having a laser beam firing hole, a semiconductor laser beam generating device mounted inside said barrel and stopped between said screw cap and the inward annular flange of said barrel and controlled to emit a laser beam out of said screw cap through said laser beam firing hole, and a rubber ring mounted inside said barrel and stopped between said semiconductor laser beam generating device and said screw cap, wherein:

said semiconductor laser beam generating device comprises four planes equiangularly spaced around the periphery; the outer diameter of said semiconductor laser beam generating device is smaller than the inner diameter of said barrel; said barrel comprises two screw holes and two locating holes equiangularly spaced around the periphery corresponding to the planes on said semiconductor laser beam, said screw holes being respectively aligned with said locating holes, two adjustment screws respectively threaded into said screw holes and stopped against the respective planes on said semiconductor laser beam generating device, two plug caps respectively fastened to said locating holes, and two spring means respectively mounted within said locating holes and stopped between said plug caps and the respective planes on said semiconductor laser beam generating device.

* * * * *